US010161290B2

(12) United States Patent
Maki et al.

(10) Patent No.: US 10,161,290 B2
(45) Date of Patent: Dec. 25, 2018

(54) COOLING SYSTEM FOR AN INTERNAL COMBUSTION ENGINE

(71) Applicant: Ford Global Technologies, LLC, Dearborn, MI (US)

(72) Inventors: Clifford E. Maki, New Hudson, MI (US); Sunil Katragadda, Canton, MI (US); Ravi Gopal, Novi, MI (US); Peter Kanefsky, Troy, MI (US); Jeffrey A. Mullins, Allen Park, MI (US); Lloyd E. Stanley, Jr., Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 399 days.

(21) Appl. No.: 14/924,058

(22) Filed: Oct. 27, 2015

(65) Prior Publication Data

US 2017/0114700 A1 Apr. 27, 2017

(51) Int. Cl.

| | |
|---|---|
| ***F01P 5/14*** | (2006.01) |
| ***F01P 3/02*** | (2006.01) |
| ***F01P 7/16*** | (2006.01) |

(52) U.S. Cl.

CPC *F01P 5/14* (2013.01); *F01P 3/02* (2013.01); *F01P 7/165* (2013.01); *F01P 2003/024* (2013.01); *F01P 2003/027* (2013.01)

(58) Field of Classification Search

CPC ..... F01P 3/02; F01P 7/165; F01P 2003/027; F01P 5/14; F01P 7/16; F01P 11/04

USPC ..... 123/41.1

See application file for complete search history.

(56) References Cited

U.S. PATENT DOCUMENTS

| | | | | |
|---|---|---|---|---|
| 3,851,629 | A * | 12/1974 | Mayr | F01P 7/16 123/41.08 |
| 4,370,950 | A * | 2/1983 | Furukubo | F01P 7/165 123/41.08 |
| 6,595,164 | B2 | 7/2003 | Kunze et al. | |
| 8,596,228 | B2 | 12/2013 | Kinomura | |

(Continued)

OTHER PUBLICATIONS

U.S. Appl. No. 14/726,759, entitled "Internal Combustion Engine and Coolant Pump", filed Jun. 1, 2015, 20 pages.

(Continued)

*Primary Examiner* — Lindsay Low
*Assistant Examiner* — Omar Morales
(74) *Attorney, Agent, or Firm* — Brooks Kushman P.C.; Julia Voutyras

(57) ABSTRACT

An engine cooling system is provided with an internal combustion engine defining a head cooling jacket and a block cooling jacket in a split flow configuration. A first thermostat is positioned at an outlet of the block cooling jacket and configured to control coolant flow therethrough. A second thermostat is positioned to receive coolant flow from the first thermostat and the head cooling jacket. The first and second thermostats are in a thermostat assembly within a housing. In response to coolant temperature being below a first threshold, a first and a second thermostat downstream of the engine in a thermostat assembly are closed such that coolant flows through a head jacket and the thermostat assembly to a pump, and such that coolant in the head jacket entrains a trickle flow of coolant from a block jacket through an interbore cooling passage, thereby cooling an interbore region.

15 Claims, 8 Drawing Sheets

(56) References Cited

U.S. PATENT DOCUMENTS

| | | | | |
|---|---|---|---|---|
| 2013/0333658 | A1* | 12/2013 | Yamamoto ..... | F02F 1/10<br>123/195 R |
| 2015/0027386 | A1 | 1/2015 | Lewis et al. | |
| 2015/0114339 | A1 | 4/2015 | Sellnau et al. | |

OTHER PUBLICATIONS

U.S. Appl. No. 14/825,577, entitled "Internal Combustion Engine Cooling System", filed Aug. 13, 2015, 22 pages.

* cited by examiner

COOLING SYSTEM FOR AN INTERNAL COMBUSTION ENGINE

TECHNICAL FIELD

Various embodiments relate to a cooling system for an internal combustion engine.

BACKGROUND

Internal combustion engines typically have an associated cooling system for thermal management and to control the temperature of the engine and engine components during operation. The cooling system, for example, with a liquid coolant, may be used to cool both the engine block and the cylinder head components, as well as provide coolant to other vehicle systems.

SUMMARY

According to an embodiment, an engine cooling system is provided with an internal combustion engine defining a head cooling jacket and a block cooling jacket in a split flow configuration. A first thermostat is positioned at an outlet of the block cooling jacket and configured to control coolant flow therethrough. A second thermostat is positioned to receive coolant flow from the first thermostat and the head cooling jacket.

According to another embodiment, a method of cooling an engine is provided. In response to coolant temperature being below a first threshold, a first and a second thermostat downstream of the engine in a thermostat assembly are closed such that coolant flows through a head jacket and the thermostat assembly to a pump, and such that coolant in the head jacket entrains a trickle flow of coolant from a block jacket through an interbore cooling passage, thereby cooling an interbore region.

According to yet another embodiment, a thermostat assembly for an engine cooling system is provided with a housing defining an inlet chamber and a mixing chamber connected by a passage. A block thermostat is supported by the housing and configured to selectively close a port between a block jacket and the inlet chamber. A main thermostat is supported by the housing in the mixing chamber and configured to selectively block the passage to control flow through a radiator.

DETAILED DESCRIPTION

As required, detailed embodiments of the present disclosure are provided herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
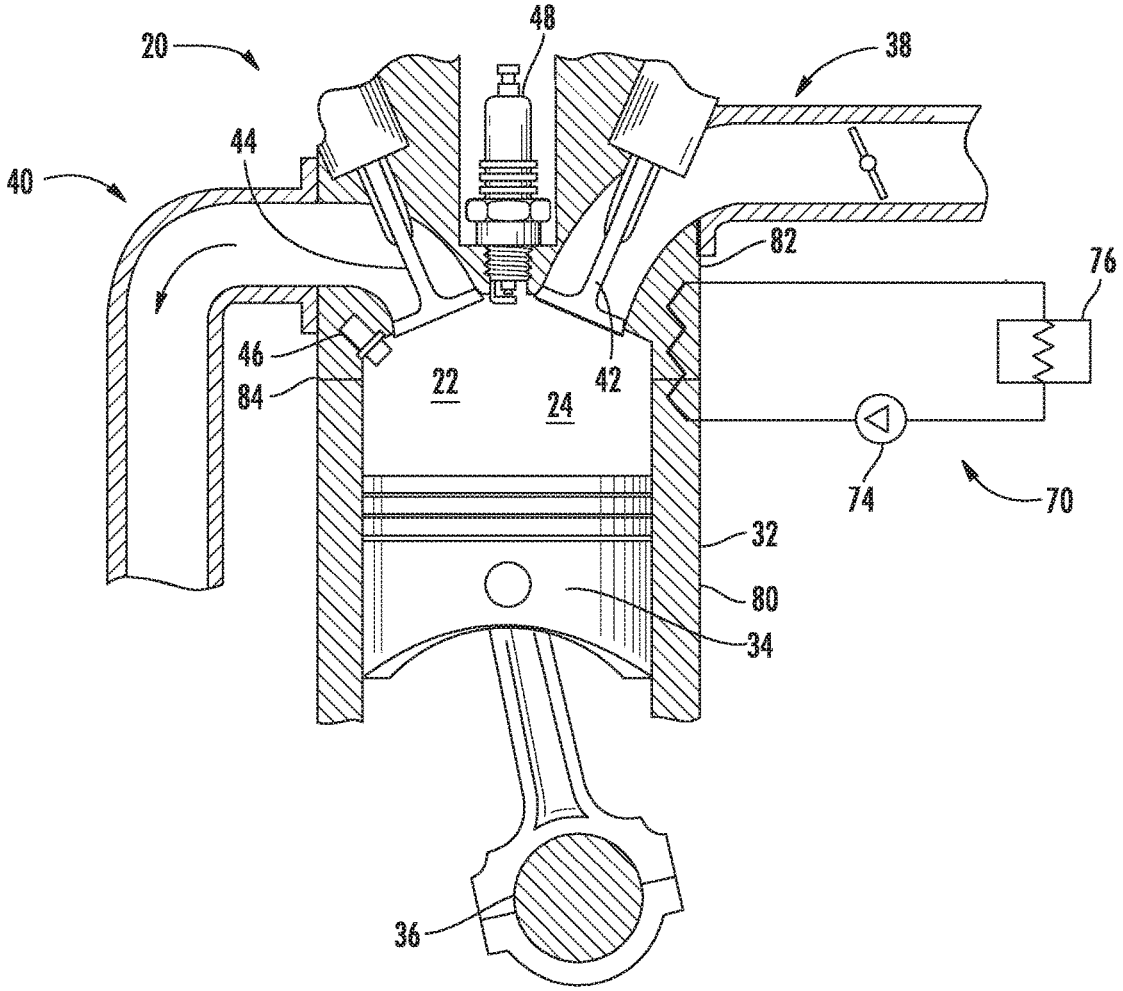
FIG. 1 illustrates a schematic of an internal combustion engine configured to implement the disclosed embodiments.

FIG. 1 illustrates a schematic of an internal combustion engine 20. The engine 20 has a plurality of cylinders 22, and one cylinder is illustrated. In one example, the engine 20 has the cylinders 22 arranged "in-line", and the cylinders 22 may be siamesed in a further example. The engine 20 has a combustion chamber 24 associated with each cylinder 22. The cylinder 22 is formed by cylinder walls 32 and piston 34. The piston 34 is connected to a crankshaft 36. The combustion chamber 24 is in fluid communication with the intake manifold 38 and the exhaust manifold 40. An intake valve 42 controls flow from the intake manifold 38 into the combustion chamber 24. An exhaust valve 44 controls flow from the combustion chamber 24 to the exhaust manifold 40. The intake and exhaust valves 42, 44 may be operated in various ways as is known in the art to control the engine operation.

A fuel injector 46 delivers fuel from a fuel system directly into the combustion chamber 24 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 24. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, and the like. Engine sensors may include, but are not limited to, an oxygen sensor in the exhaust manifold 40, an engine coolant temperature sensor, an accelerator pedal position sensor, an engine manifold pressure (MAP) sensor, an engine position sensor for crankshaft position, an air mass sensor in the intake manifold 38, a throttle position sensor, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two stroke cycle. During the intake stroke, the intake valve 42 opens and the exhaust valve 44 closes while the piston 34 moves from the top of the cylinder 22 to the bottom of the cylinder 22 to introduce air from the intake manifold to the combustion chamber. The piston 34 position at the top of the cylinder 22 is generally known as top dead center (TDC). The piston 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber 24.

Fuel is then introduced into the combustion chamber 24 and ignited. In the engine 20 shown, the fuel is injected into the chamber 24 and is then ignited using spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve 42 remains closed, and the exhaust valve 44 opens. The piston 34 moves from the bottom of the cylinder to the top of the cylinder 22 to remove the exhaust gases and combustion products from the combustion chamber 24 by reducing the volume of the chamber 24. The exhaust gases flow from the combustion cylinder 22 to the exhaust manifold 40 and to an aftertreatment system such as a catalytic converter.

The intake and exhaust valve 42, 44 positions and timing, as well as the fuel injection timing and ignition timing may be varied for the various engine strokes.

The engine 20 includes a cooling system 70 to remove heat from the engine 20. An embodiment of the cooling system 70 is described below in greater detail with reference to FIG. 2. The cooling system 70 may be integrated into the engine 20 as one or more cooling circuits. The cooling system 70 may contain a liquid coolant as the working fluid. Coolant, such as water, in the cooling system 70 flows from an area of high pressure towards an area of lower pressure.

The cooling system 70 has one or more pumps 74, and may also include one or more valves, thermostats, and the like to control to flow or pressure of coolant, or direct coolant within the system 70. The cooling system 70 may also include various heat exchangers, such as a radiator 76, where heat is transferred from the coolant to the environment or the coolant is used to cool or heat other engine or vehicle components and/or working fluids.

At least some of the cooling passages in the cylinder block 80 may form a cooling jacket surrounding and adjacent to one or more of the cylinders 22 and the bore bridges formed between adjacent cylinders 22. Similarly, at least some of the cooling passages in the cylinder head 82 may be adjacent to one or more of the combustion chambers 24 and cylinders 22, and the bore bridges formed between the combustion chambers 24, exhaust valves, exhaust valve seats, and other components.

The cylinder head 82 is connected to the cylinder block 80 to form the cylinders 22 and combustion chambers 24. A head gasket 84 is positioned between the cylinder block 80 and the cylinder head 82 to seal the cylinders 22. The gasket 84 may also have various slots, apertures, or the like to fluidly connect the cooling passages in the block 80 and the head 82.

Figure 2:
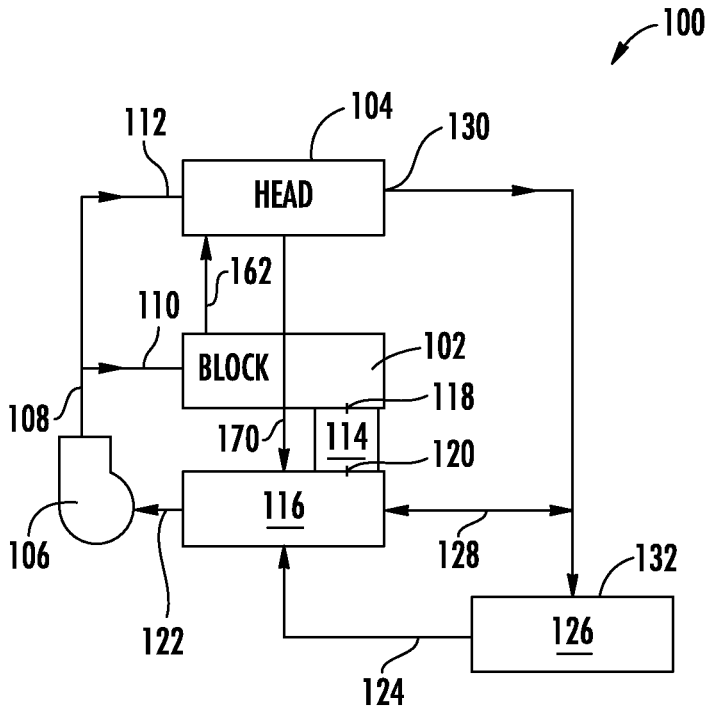
FIG. 2 illustrates a schematic of a cooling system for use with the engine of FIG. 1 according to an embodiment.

FIG. 2 illustrates a schematic of a cooling system 100 for use with the engine of FIG. 1 according to an embodiment, for example, as cooling system 70. The cooling system 100 provides coolant to an engine block 102 and a cylinder head 104. The cooling system 100 may also provide coolant to other vehicle components, engine components, or cooling system components, such as an exhaust gas recirculation (EGR) heat exchanger, a turbocharger, a intercooler heat exchanger for a turbocharger, a heat exchanger such as a heater for a vehicle HVAC system, an engine lubrication heat exchanger, a degas bottle, and the like. These components are omitted from the schematic for simplification.

The cooling system 100 has a pump 106 that provides pressurized coolant to a pump outlet 108. Coolant in the pump outlet is divided or split between the block 102 and the head 104 in a split flow or parallel flow configuration. The cooling passages in the pump outlet 108 may be integrated as internal passages in the engine, e.g. the engine block 102. Examples of a pump and/or cooling passages providing coolant flow into the engine and dividing flow between the block and the head are provided in U.S. patent application Ser. No. 14/726,759 filed Jun. 1, 2015, now U.S. Pat. No. 9,784,175, issued Oct. 10, 2017 and U.S. patent application Ser. No. 14/825,577 filed Aug. 13, 2015, now U.S. Pat. No. 9,810,134, issued Nov. 7, 2017, the disclosures of which are incorporated by reference in their entirety herein.

The coolant flows into the cooling jacket for the block at 110, and the coolant flows into the cooling jacket for the head at 112.

The cooling system 100 has two thermostats positioned downstream of the engine. The first thermostat 114 is referred to herein as the block thermostat. The second thermostat 116 is referred to herein as the main or radiator thermostat. In some examples, the thermostats 114, 116 may be provided as an integral unit or in a single thermostat housing or assembly as described below.

The block thermostat 114 has an inlet 118 that receives coolant from the block 102 cooling jacket. The block thermostat 114 has an outlet 120 that provides coolant to a mixing chamber upstream of the pump 106 or to the pump inlet 122. For example, when the thermostat 114 is open or in a first position, coolant flows from the block 102 to the pump inlet 122. When the thermostat 114 is closed or in a second position, no coolant flows across the thermostat 114, such that the coolant outlet 118 from the block cooling jacket is closed or blocked. Note that even when the thermostat 114 is closed, the block 102 jacket has stagnant pressurized coolant via inlet 110.

The main thermostat 116 has an inlet 124 that receives coolant from a heat exchanger 126 such as a radiator. The thermostat 116 also has a fluid connection 128. The fluid connection 128 is in fluid communication with an outlet from the head cooling jacket 130 and an inlet to the heat exchanger 132. Flow through the fluid connection changes depending on the state of the thermostat 116. For example, when the thermostat 116 is in a first position or open, coolant flow through line 124 into the thermostat 116 is opened and a bypass pathway is closed such that coolant flows from the main thermostat 116 from left to right through line 128, merges with coolant from the head jacket at 130, flows through the radiator 126, and through line 124 to the pump inlet 122. When the thermostat 116 is closed or in a second position it acts as a bypass for the radiator, and coolant flow through line 124 is blocked or closed such that no coolant flows through the radiator 126, and coolant from the head cooling jacket at 130 flows through line 128 from right to left and into the main thermostat 116, and to the pump inlet 122.

The cooling jackets of the head 104 and the block 102 are in fluid communication with one another. Coolant in the block 102 flows through the block and to the thermostat 114 via passage 118. Coolant in the block 102 cooling jacket may also flow into the head 104 cooling jacket via interbore cooling passages, as described below.

The head 104 cooling jacket may include one or more cooling jackets, for example, an upper and a lower head cooling jacket. Coolant in the head may flow through the head 104 and exit the head at 130. Coolant in the head 104 may also flow back into passages 170 through the block and to the thermostats 114, 116.

Each thermostat 114, 116 may be a mechanical thermostat, for example, having a sealed chamber containing a wax element or other element that melts and expands at a set temperature or temperature threshold. When the set temperature is reached, the wax melts and expands the chamber to operate a rod or other mechanical element to move a valve disc and open a valve. The composition of the wax element determines the set temperature for melting and operation of the thermostat. In other examples, the thermostat may be an electrically controlled mechanism, or another mechanical thermostat.

The two thermostats 114, 116 are configured to operate and open at different operating temperatures. The block thermostat 114 has a lower operating temperature or lower set temperature than the main thermostat 116, such that the block thermostat opens at a lower coolant temperature than the main thermostat 116. In one example, the block thermostat 114 opens at approximately 70 degrees Celsius, and the main thermostat opens at approximately 90 degrees Celsius.

Conventional cooling systems are typically configured in either a series flow configuration with coolant flowing sequentially through the block and then the head, or as a parallel flow configuration with coolant divided and flowing simultaneously through the block and head. These conventional systems may have decreased control over the thermal management and temperatures of the engine at various operating states, for example, after an engine cold start and through the initial warm up phase, which may result in uneven deck temperatures, hot spots particularly in the interbore regions, lengthened the uneven heating times for the engine and the coolant, and higher combustion gas emissions.

The present disclosure provides for a block thermostat 114 and a main thermostat 116 that are both located downstream of the engine and upstream of the pump inlet, as shown in FIG. 2.

FIGS. 3-7 illustrates various components of an engine and cooling system for use with the cooling system of FIG. 2. The example shown provides for a flow circuit to manage the thermal gradients of the engine block and the cylinder head components, and the operating temperature of the engine and its components, during an initial engine start, a warming up phase, and normal operating conditions. The engine, cooling system, and thermostat assembly enables the engine to have a split flow, parallel cooling strategy with controlled flow of the coolant based on the engine operating state.

Figure 3:
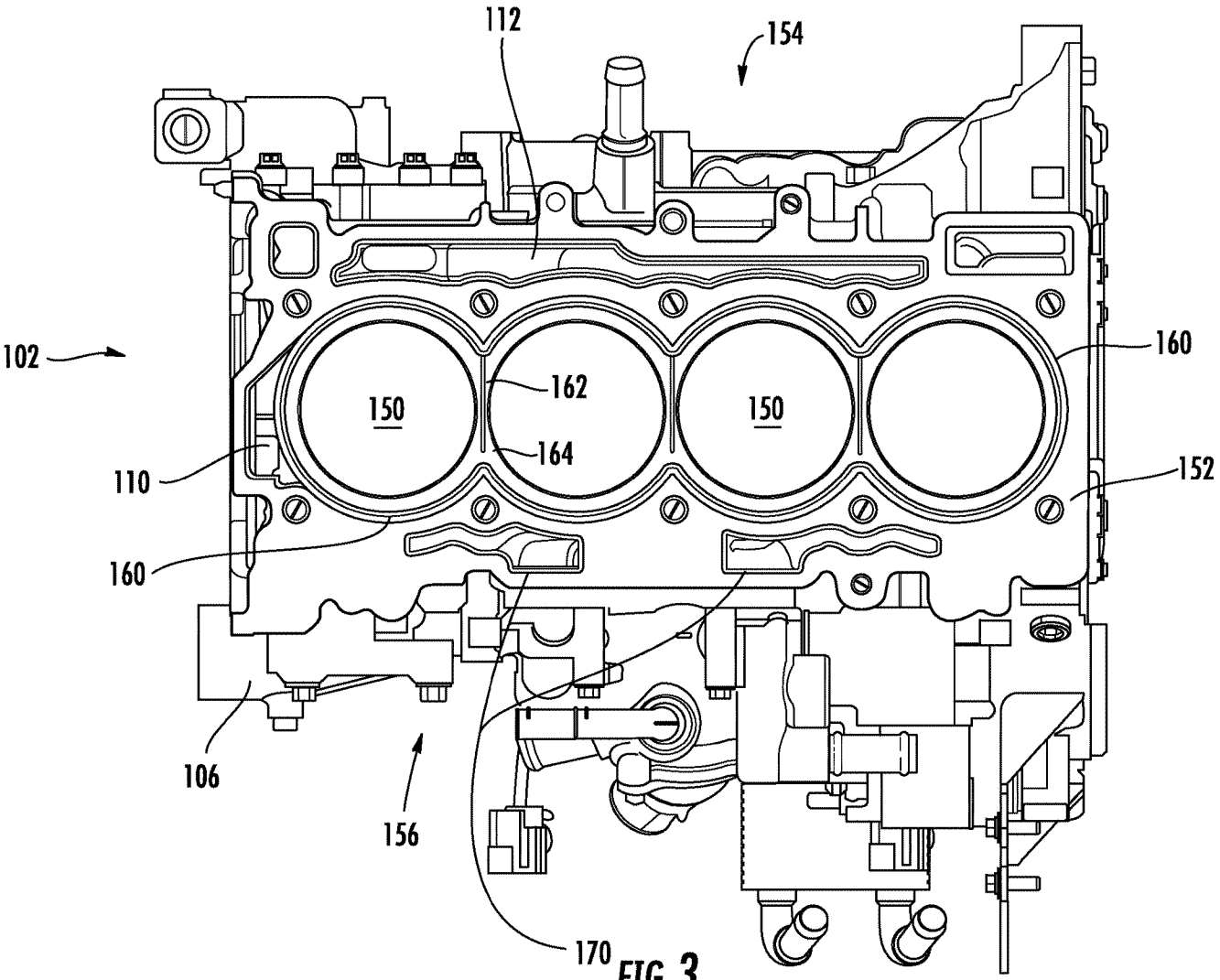
FIG. 3 illustrates a top perspective view of a cylinder block of an engine for use with the cooling system of FIG. 2.

FIG. 3 illustrates a top view of an engine block 102 for an internal combustion engine for use with the cooling system 100. In one example, the engine block 102 may be used with the engine 20 of FIG. 1. The engine block 102 is shown as having four cylinders 150 arranged in an in-line, siamesed configuration along a longitudinal axis of the block 102, although other numbers of cylinders 150 and arrangements for the cylinders is contemplated for other embodiments.

The block 102 has a deck face 152, an intake side 156 associated with the air intake and intake valves, and an exhaust side 154 associated with the cylinder exhaust gases and the exhaust valves. The deck face 152 of the block 102 is configured to mate with a corresponding deck face of the cylinder head, and a head gasket may be positioned therebetween to seal the cylinders 150.

The engine block 102 includes a cooling jacket 160 that surrounds an outer perimeter or circumference of the cylinder liners or cylinder walls. Coolant flows into the block 102 from the pump 106, and is divided within the block into a coolant flow to the block cooling jacket 160 at 110, and a coolant flow to the head cooling jacket at 112.

The cooling jacket 160 includes various cooling passages that may be integrally formed within the block, for example, during a casting process, molding process, or by machining the block 102 after formation. The cooling jacket 160 also includes interbore cooling passages 162 located in the interbore regions 164 between adjacent cylinders. The interbore cooling passages 162 may be provided as open channels, slots, or sawcuts in the block deck face 152. The interbore cooling passages 162 may extend only partially across the interbore region 164, and may be connected to the intake side 156 and/or the exhaust side 154 of the engine. The interbore cooling passages may be fluidly connected to the cooling jacket 160 on the intake side 156 of the engine where the coolant may be at a lower temperature compared to the exhaust side 154 of the engine.

Coolant flows into the head cooling jacket through the coolant passage 112. Coolant may also flow into the head via the interbore cooling passages 162, as illustrated schematically in FIG. 2. Coolant may also flow from the head back through the block and to the thermostat 116 via the passages 170 or return channels, also illustrated schematically in FIG. 2. Although the block 102 is illustrated as having two passages 170, the block may be also be configured with a single passage 170 or multiple passages 170. Note that the passage 170 may not have a direct, uncontrolled fluid connection with the jacket 160 although they are positioned adjacent to one another.

Figure 4:
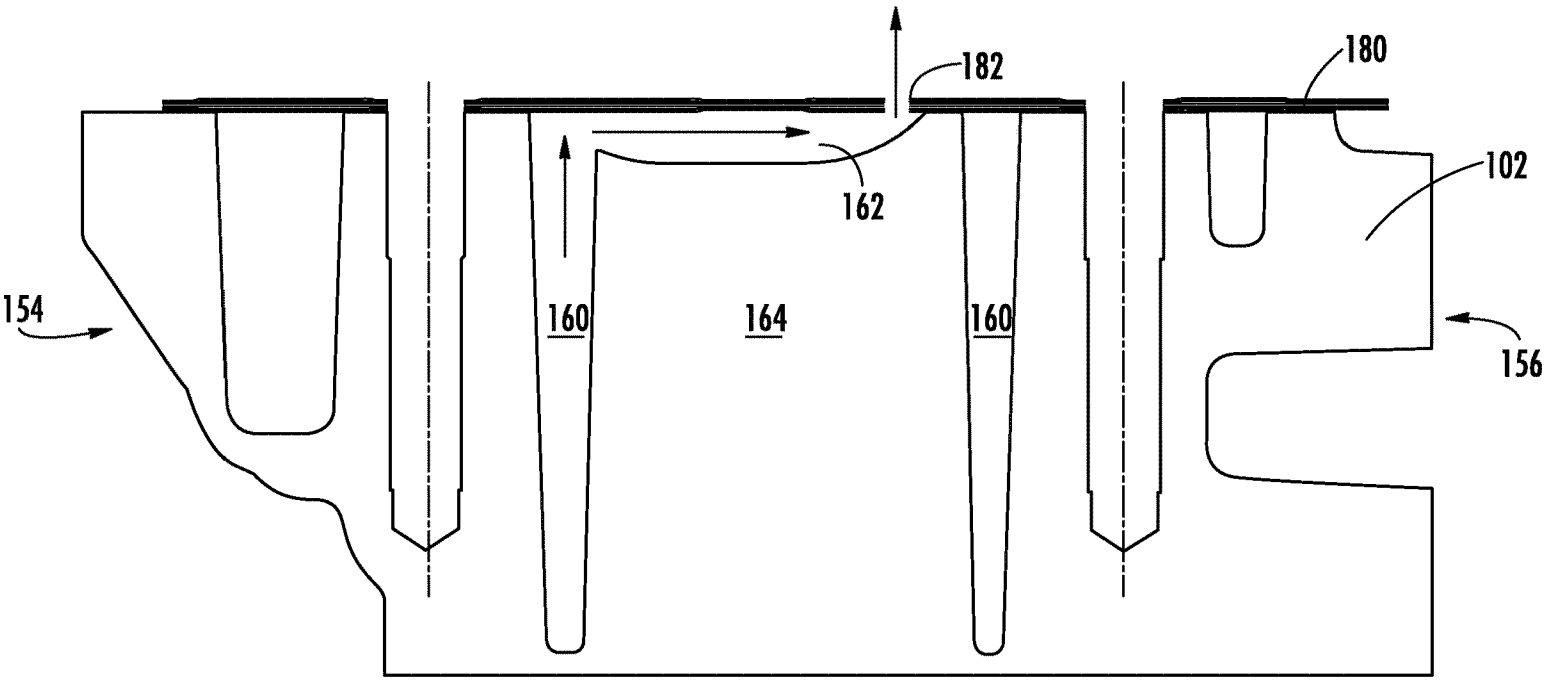
FIG. 4 illustrates a sectional view of the cylinder block and engine of FIG. 3.

Referring to FIG. 4, flow through the interbore cooling passage 162 of the block 102 is illustrated. The coolant flows through the block cooling jacket 160 and into the interbore passage 162, illustrated as a saw cut. Coolant then flows through an aperture 182 provided in the head gasket 180 and into the cylinder head cooling jacket. As the thermostats 114, 116 are located downstream of the engine, the coolant within the jacket 160 is always pressurized as inlet 110 maintains a fluid connection between the pump outlet 108 and the jacket 160. Depending on the state of the thermostats, as described below, the coolant may be stagnant or flowing through the jacket 160.

Figure 5:
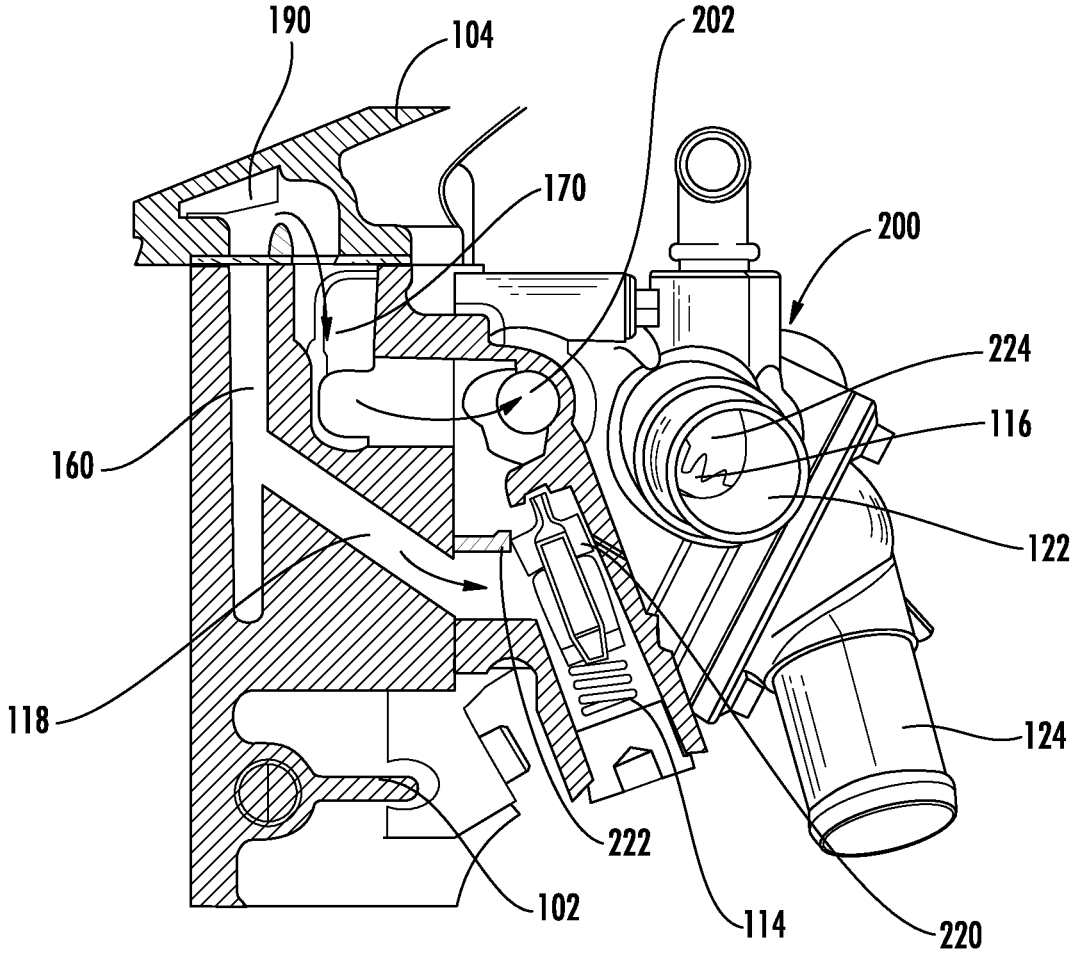
FIG. 5 illustrates a sectional view of the engine and thermostat assembly of FIG. 2.

FIG. 5 illustrates a partial sectional view of the engine taken through a thermostat housing 200. The thermostat housing 200 is connected to the block 102 and the engine on the exhaust side 154, and supports both the block thermostat 114 and the main thermostat 116.

Coolant in the block cooling jacket 160 flows into the thermostat housing 200 via passage 118. Coolant from the head cooling jacket 190 flows into the thermostat housing 200 via passage 170.

The block thermostat 114 is illustrated in a closed position. As the coolant increases in temperature, the block thermostat opens at its associated set temperature such that valve disc 220 moves away from passage 222, and coolant flows from the passage 118 across the thermostat 114 and into region 202 or inlet chamber 202 in the housing 200, and to the bypass or pump line 122.

Figure 6:
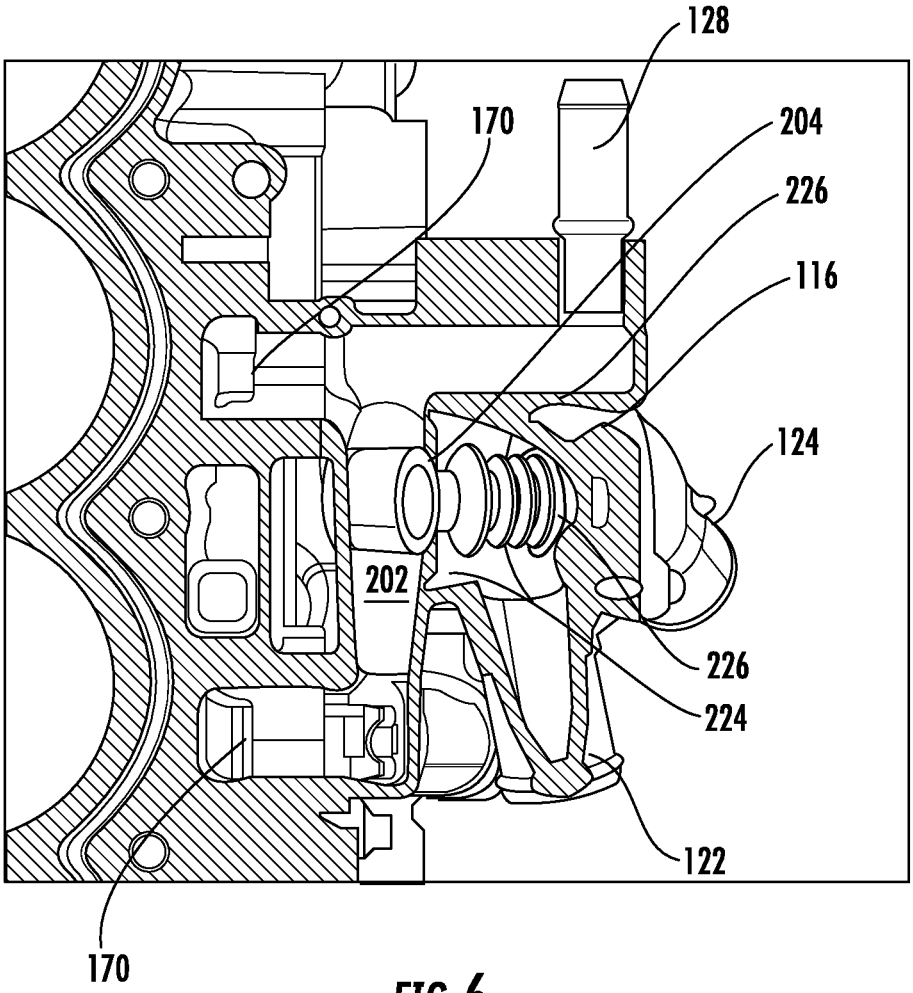
FIG. 6 illustrates another sectional view of the engine and thermostat assembly of FIG. 2.

The main thermostat 116 is adjacent to the block thermostat 114. The main thermostat 116 as illustrated in FIG. 6 is in a closed position, where coolant within region 202 may flow through passage 204 into the mixing chamber 224 and to the bypass or pump line 122. In the closed position, one of the lines 128 to the radiator remains in constant fluid communication with the chamber 202, while a valve disc 226 the main thermostat 116 closes or blocks line 124 as shown. When the coolant temperature has increased to the set temperature of the main thermostat 116, the main thermostat 116 operates such that valve disc 228 closes off passage 204, thereby forcing coolant in region 202 to flow through line 128, to the radiator 126, back through return line 124 and the mixing chamber 224, and to the pump via line 122.

Note that line 206 is an auxiliary line that may be connected to a heater, or used with another vehicle, engine, or cooling system component.

Figure 7:
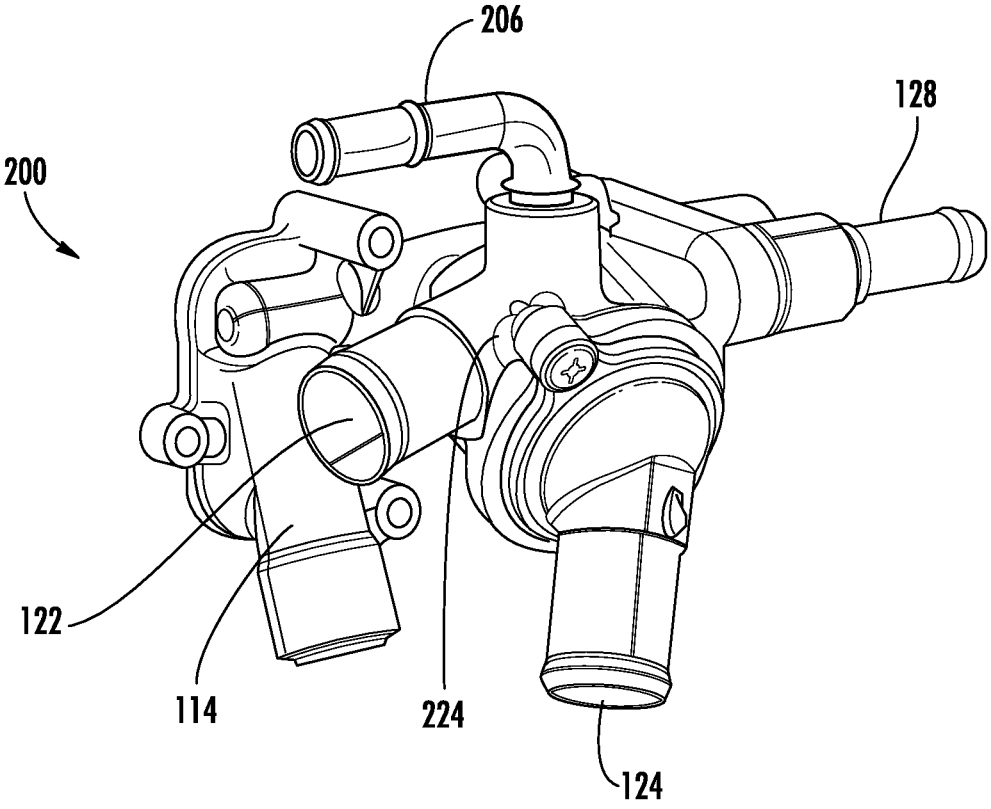
FIG. 7 illustrates a front perspective view of a thermostat housing for use with the system of FIG. 2.
Figure 8:
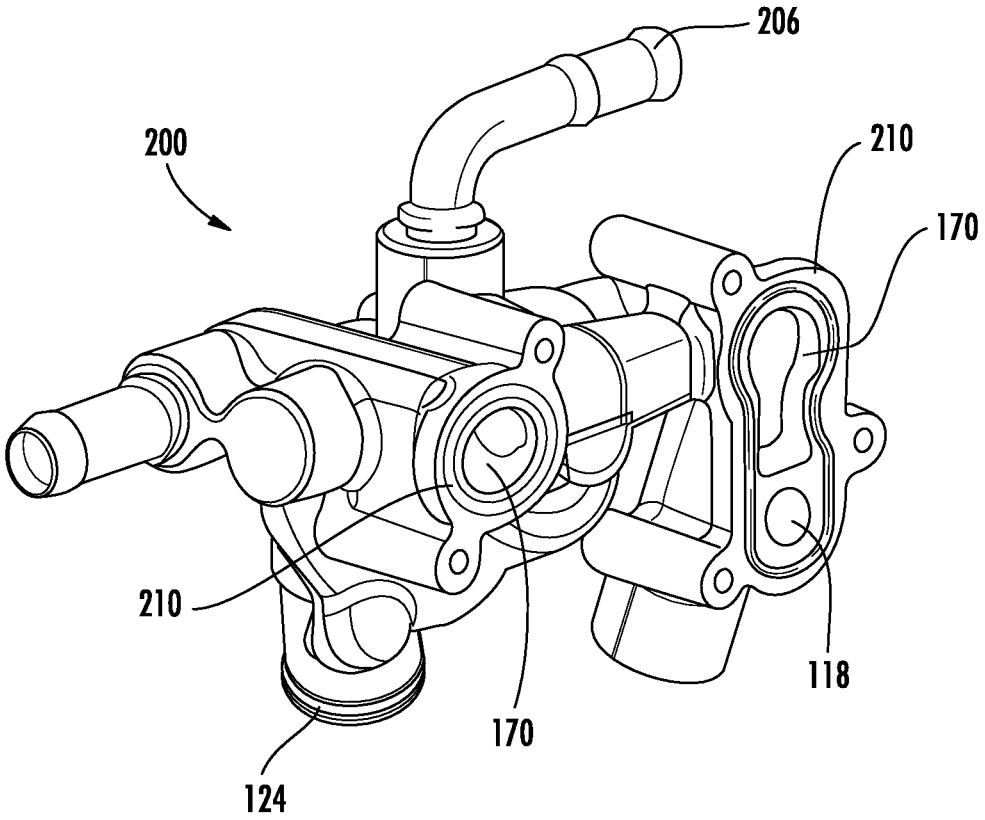
FIG. 8 illustrates a rear perspective view of the thermostat housing of FIG. 6.

FIG. 7-8 illustrate perspective views of the thermostat housing 200 or thermostat assembly 200 including the various fluid connections for the cooling system 100. The thermostat housing 200 has mounting flanges 210 to connect and seal the thermostat housing with the cooling passages on the engine block 102. Note that the mounting flanges maintain separate flows through fluid connections 118, 170 into the housing 200.

The housing 200 also provides a mixing chamber 224 within the housing to mix the flows of coolant from the cylinder block and the cylinder head before they flow to the pump or the pump via the radiator. The mixing chamber 224 also serves as the chamber surrounding the main thermostat 116.

Both of the thermostats 114, 116 are contained in a single housing 200 that includes a bypass and a mixing chamber 224 receiving coolant from the head 104, block 102, radiator 126, and other cooling system components or fluid circuits.

During an engine cold start at low coolant temperatures, or where the coolant temperature is below a first threshold (T1), the cooling system 100 is operated such that coolant only flows through the head cooling jacket 190 with a slight coolant flow through the bore bridge cooling passages 162. This allows for cooling of the head 104 with the exhaust passages, while allowing the block 102 temperature and coolant temperature to increase towards their operating temperatures. Both thermostats 114, 116 are closed such that coolant flows from the pump 106 through the head 104, to passages 170 and chambers 202, 224 and then back to the pump 106 through a thermostat bypass or the pump line 122 to allow for faster warm up of the engine. Coolant from the head jacket 190 may also flow into the chamber 202 of the thermostat assembly 200 via passage 128. During this cold start cooling process, the cooling system 100 allows for a low coolant flow or trickle flow in the bore bridge passages 162 and across the bore bridges 164 in the block 102 based on flow from the high pressure stagnant coolant in the block jacket 160 to the lower pressure coolant in the head jacket 190. The closed thermostat 114 prevents bulk flow of coolant through the block jacket 160. The closed thermostat 116 of the cooling system 100 prevents coolant flow through the radiator 126 and other components such as an oil cooler during cold start.

The trickle flow across the bore bridge and through the bore bridge cooling passages 162 is caused by the flowing coolant in the head jacket 190 entraining coolant within the passages 162 based on a pressure difference between the jackets 160, 190. Note that although a trickle flow is provided across the bore bridges for cooling, the coolant in the block jacket 160 has a substantially stagnant bulk flow to allow for the block 102 and coolant temperature to increase.

During an intermediate, or warm state at a moderate coolant temperature, or where the coolant temperature is above a first threshold (T1) and below a second threshold (T2), the cooling system 100 is operated such that coolant only flows through the head cooling jacket 190 and the block cooling jacket 160. This allows for cooling of the head 104 and the block 102, while allowing the coolant temperature to continue to increase towards its operating temperatures. The block thermostat 114 opens while the main thermostat 116 remains closed. Coolant flows from the pump 106, through the head 104 and head jacket 190 and the block 102 and block jacket 160, to chamber 202 in the thermostat housing, through passage 204 to the mixing chamber 224, and to fluid line 122 to return to the pump 106. Coolant may also flow into the chamber 202 of the thermostat assembly 200 via fluid connection 128. The closed thermostat 116 of the cooling system 100 prevents coolant flow through the radiator 126 and other components such as an oil cooler during the warm state to allow the coolant temperature to continue to rise.

During a hot state at a high or normal coolant temperature, or where the coolant temperature is above the second threshold (T2), the cooling system 100 is operated such that coolant flows through the head cooling jacket 190 and the block cooling jacket 160, and to the radiator 126. This allows for cooling of the head 104 and the block 102, while also controlling the coolant temperature via heat transfer in the radiator 126. The block thermostat 114 and the main thermostat 116 are open. Coolant flows from the pump 106, through the head 104 and head jacket 190 and the block 102 and block jacket 160, to chamber 202 in the thermostat housing, though line 128 to the radiator 126, back to the thermostat housing 200 from the radiator 126 through line 124, into the mixing chamber 224, and to the fluid line 122 to the pump 106. Note that passage 204 is closed by the thermostat 116.

The table below summarizes the operating states for the cooling system 100.

| Operating State | Coolant temperature (T) | Block Thermostat | Main Thermostat | General coolant flow in system |
|---|---|---|---|---|
| Cold | T < T1 | Closed | Closed | pump, head, pump |
| Warm | T1 < T < T2 | Open | Closed | pump, block and head, pump |
| Hot | T2 < T | Open | Open | pump, block and head, radiator, pump |

The cooling system 100 and controlled heating of the engine and block may decrease the engine warm-up time compared to a conventional series flow or parallel flow engine. The single thermostat housing 200 that contains both thermostats 114, 116 allows for a mixing chamber 224 between coolant flows, improved sealing and reduced coolant leak issues, and reduced packaging space and cost associated with the component.

By locating the main and block thermostats 114, 116 downstream of the engine, the flow may be controlled during cold start to provide pressurized stagnant flow in the block 102, flow through the head 104, and a continuous trickling or low coolant flow through the bore bridge passage 162 to the head to thermally manage the bore bridges 164 and prevent or reduce hot spots in block.

For example, during an engine start such as a cold start with a subsequent engine warm up, a conventional coolant flow strategy for an engine may not allow the block to warm up as fast as the cylinder head. In the block, the interbore bridge also may warm up faster than the surrounding cylinder bore wall with a resulting thermal hot spot and associated bore deformation and head gasket issues. The thermal gradient of the block deck face also has a concentration of heat in the inter-bore bridge region.

The cooling system according to the present disclosure manages the thermal gradient using a bore bridge cooling strategy (flowing from block to head) to cool the bore bridge on an engine with a split cooling configuration where the coolant flow through the cylinder block is stopped or kept stagnant for quick warm-up. This bore bridge cooling strategy enables an extension of the split cooling duration for the engine block since there is continuous cooling of the bore bridges even when bulk coolant flow through the engine block is stopped or stagnant. The unique constant or continuous flow across the interbore bridge also allows for a faster cylinder block warm up. This interbore passage allows for control of the bore bridge metal temperature without weakening the bridge structure and compromising head gasket sealing.

The interbore cooling passages or saw cuts in block interbore bridges allows for continuous coolant flow while the block water jacket flow is stopped using a thermostat 114 located at a block outlet port.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. An engine cooling system comprising:

an internal combustion engine defining a head cooling jacket and a block cooling jacket in a split flow configuration;

a first thermostat positioned at an outlet of the block cooling jacket and configured to control coolant flow therethrough;

a second thermostat positioned to receive coolant flow from the first thermostat and the head cooling jacket; and a thermostat housing supporting the first and second thermostats, the housing defining a first chamber and a second chamber fluidly connected by a passage, the first chamber having a first port connected to the block cooling jacket, a second port connected to the head cooling jacket, and a third port connected to an inlet to a heat exchanger, the second chamber having a fourth port connected to an outlet from the heat exchanger, and a fifth port connected to an inlet to a pump;

wherein the first thermostat has a first position blocking the first port and a second position fluidly connecting the first port and the first chamber; and wherein the second thermostat is positioned in the second chamber and has a first position blocking the passage and a second position blocking the fourth port.

2. The system of claim 1, further comprising a pump positioned to receive coolant from the second thermostat and provide coolant to an inlet to the head cooling jacket and an inlet to the block cooling jacket.

3. The system of claim 1, wherein the second chamber is a mixing chamber connected to an outlet of the first thermostat, an outlet of the head cooling jacket, and the second thermostat.

4. The system of claim 3, further comprising a heat exchanger;

wherein the second thermostat is configured to directly fluidly couple the mixing chamber with a pump in the second position, and is configured to fluidly couple the mixing chamber to the pump via the heat exchanger in the first position.

5. The system of claim 4, wherein the first thermostat is configured to block coolant flow at the outlet of the block cooling jacket in the first position, and is configured to fluidly couple the block cooling jacket with the mixing chamber in the second position.

6. The system of claim 4, wherein the first thermostat is in the first position when coolant temperature is below a first set temperature.

7. The system of claim 6, wherein the second thermostat is in the second position when coolant temperature is below a second set temperature, the second temperature greater than the first temperature.

8. The system of claim 1, wherein the head cooling jacket and the block cooling jacket are provided in a parallel, split flow configuration.

9. The system of claim 1, wherein the block cooling jacket has at least one interbore cooling passage fluidly coupled with the head cooling jacket.

10. The system of claim 1, wherein the block cooling jacket has a block inlet fluidly coupled with a pump, and at least one interbore cooling passage fluidly coupled with the head cooling jacket to provide a first block outlet, and wherein the outlet of the block cooling jacket is a second block outlet fluidly coupled to the first thermostat.

11. The system of claim 10, wherein the head cooling jacket has a head inlet fluidly coupled with the pump, an interbore inlet fluidly coupled with the first block outlet, and a second head outlet fluidly coupled with the second thermostat.

12. An engine coolant thermostat assembly comprising:

a housing defining a passage connecting an inlet chamber to a downstream mixing chamber;

a block thermostat supported by the housing and configured to selectively close a port between a block jacket and the inlet chamber; and a main thermostat supported by the housing in the mixing chamber and having a first position blocking a radiator return port into the mixing chamber, and a second position blocking the passage.

13. The engine coolant thermostat assembly of claim 12, wherein the main thermostat is in the first position when coolant temperature is below a first set temperature.

14. The engine coolant thermostat assembly of claim 13, wherein the block thermostat has a first position blocking the port between the block jacket and the inlet chamber, and a second position spaced away from the port between the block jacket and the inlet chamber.

15. The engine coolant thermostat assembly of claim 14, wherein the block thermostat is in the first position when coolant temperature is below a second set temperature; and wherein the first set temperature is greater than the second set temperature.

* * * * *